US011970926B2

(12) United States Patent
Al-Mousa

(10) Patent No.: US 11,970,926 B2
(45) Date of Patent: Apr. 30, 2024

(54) ELECTRIC SUBMERSIBLE PUMP COMPLETION WITH WET-MATE RECEPTACLE, ELECTRICAL COUPLING (STINGER), AND HYDRAULIC ANCHOR

(71) Applicant: SAUDI ARABIAN OIL COMPANY, Dhahran (SA)

(72) Inventor: Ahmed Al-Mousa, Doha (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 143 days.

(21) Appl. No.: 17/331,127

(22) Filed: May 26, 2021

(65) Prior Publication Data

US 2022/0381121 A1 Dec. 1, 2022

(51) Int. Cl.

| | |
|---|---|
| ***E21B 17/02*** | (2006.01) |
| ***E21B 33/129*** | (2006.01) |
| ***E21B 43/12*** | (2006.01) |
| ***F04D 13/10*** | (2006.01) |

(52) U.S. Cl.

CPC ..... *E21B 43/128* (2013.01); *E21B 17/028* (2013.01); *E21B 33/1293* (2013.01); *F04D 13/10* (2013.01)

(58) Field of Classification Search

CPC ... E21B 43/128; E21B 17/028; E21B 33/1293
See application file for complete search history.

(56) References Cited

U.S. PATENT DOCUMENTS

| | | | | |
|---|---|---|---|---|
| 4,474,243 A * | 10/1984 | Gaines | E21B 33/143 175/171 |
| 4,589,717 A * | 5/1986 | Pottier | E21B 17/028 439/190 |
| 9,175,523 B2 | 11/2015 | Patel et al. | |
| 9,270,051 B1 | 2/2016 | Christiansen et al. | |
| 9,970,250 B2 | 5/2018 | Hess et al. | |

(Continued)

FOREIGN PATENT DOCUMENTS

| | | |
|---|---|---|
| CA | 2531301 C | 3/2011 |
| EP | 1815101 B1 | 8/2012 |

(Continued)

*Primary Examiner* — Giovanna Wright
*Assistant Examiner* — Ronald R Runyan
(74) *Attorney, Agent, or Firm* — Osha Bergman Watanabe & Burton LLP

(57) ABSTRACT

A system includes an upper section, having a first lateral end. The upper section has upper production tubing configured to be a conduit for production fluids, an upper electrical cable configured to transmit electricity, and a sub-surface safety valve fixed to the upper production tubing. The system further includes a lower section having a second lateral end, lower production tubing configured to be a conduit for the production fluids, a lower electrical cable configured to transmit electricity, an electric submersible pump assembly, and an anchor configured to hold the lower section within the casing string. A stinger assembly is fixed to the first lateral end of the upper section, and a stinger receptacle is fixed to the second lateral end of the lower section. The stinger receptacle is configured to receive the stinger assembly and create an electrical connection between the upper section and the lower section.

17 Claims, 5 Drawing Sheets

(56) References Cited

U.S. PATENT DOCUMENTS

| | | | | |
|---|---|---|---|---|
| 2005/0279510 | A1* | 12/2005 | Patel | E21B 33/12 166/380 |
| 2008/0227322 | A1* | 9/2008 | Nicholson | H01R 13/523 439/271 |
| 2009/0242212 | A1* | 10/2009 | Shaw | E21B 43/128 166/65.1 |
| 2010/0270032 | A1* | 10/2010 | Monjure | E21B 33/03 166/381 |
| 2011/0011596 | A1 | 1/2011 | Martinez et al. | |
| 2013/0306316 | A1 | 11/2013 | Patel | |
| 2013/0327138 | A1* | 12/2013 | Richard | E21B 47/12 73/152.54 |
| 2018/0187493 | A1* | 7/2018 | Lastra | E21B 17/028 |

FOREIGN PATENT DOCUMENTS

| | | | |
|---|---|---|---|
| EP | 2673458 | B1 | 8/2019 |
| WO | 2013034378 | A1 | 3/2013 |
| WO | 2017115094 | A1 | 7/2017 |

* cited by examiner

ELECTRIC SUBMERSIBLE PUMP COMPLETION WITH WET-MATE RECEPTACLE, ELECTRICAL COUPLING (STINGER), AND HYDRAULIC ANCHOR

BACKGROUND

Hydrocarbon fluids are often found in hydrocarbon reservoirs located in porous rock formations far below the earth's surface. Wells may be drilled to extract the hydrocarbon fluids from the hydrocarbon reservoirs. Wells may have a variation of downhole equipment, such as an Electrical Submersible Pump (ESP) string, installed to help with the production of hydrocarbons. A sub-surface safety valve (SSSV) may be installed within the upper portion of the ESP string, and a wellhead may be located on the Earth's surface to support the sub-surface portion of the well, such as the ESP string. Over the life of the well, the SSSV and/or the wellhead may need to be repaired/replaced. To do so, the non-defective ESP string may need to be de-completed and taken out of the well. When a non-defective ESP string is removed from the well and de-completed, a new ESP string must be installed when repairs to/replacement of the SSSV and/or wellhead are completed.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in one or more embodiments, a system and a method for a well having a casing string. In general, the system includes an upper section, having a first lateral end. The upper section has upper production tubing configured to be a conduit for production fluids, an upper electrical cable configured to transmit electricity, and a sub-surface safety valve fixed to the upper production tubing. The system further includes a lower section, having a second lateral end. The lower section has lower production tubing configured to be a conduit for the production fluids, a lower electrical cable configured to transmit electricity, an electric submersible pump assembly, and an anchor configured to hold the lower section within the casing string. A stinger assembly is fixed to the first lateral end of the upper section, and a stinger receptacle is fixed to the second lateral end of the lower section. The stinger receptacle is configured to receive the stinger assembly and create an electrical connection between the upper section and the lower section.

In other embodiments, the method includes running a lower section, having a weight, into the casing string. The lower section includes lower production tubing configured to be a conduit for production fluids, a lower electrical cable configured to transmit electricity, a stinger receptacle configured to receive a stinger assembly, an electric submersible pump assembly, and an anchor configured to hold the weight of the lower section. The method further includes setting the anchor against the casing string to hold the lower section within the casing string and running an upper section into the casing string. The upper section includes upper production tubing configured to be a conduit for the production fluids, an upper electrical cable configured to transmit electricity, the stinger assembly configured to enter the stinger receptacle, and a sub-surface safety valve fixed to the upper production tubing. The stinger assembly is inserted into the stinger receptacle to create an electrical connection between the upper section and the lower section.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
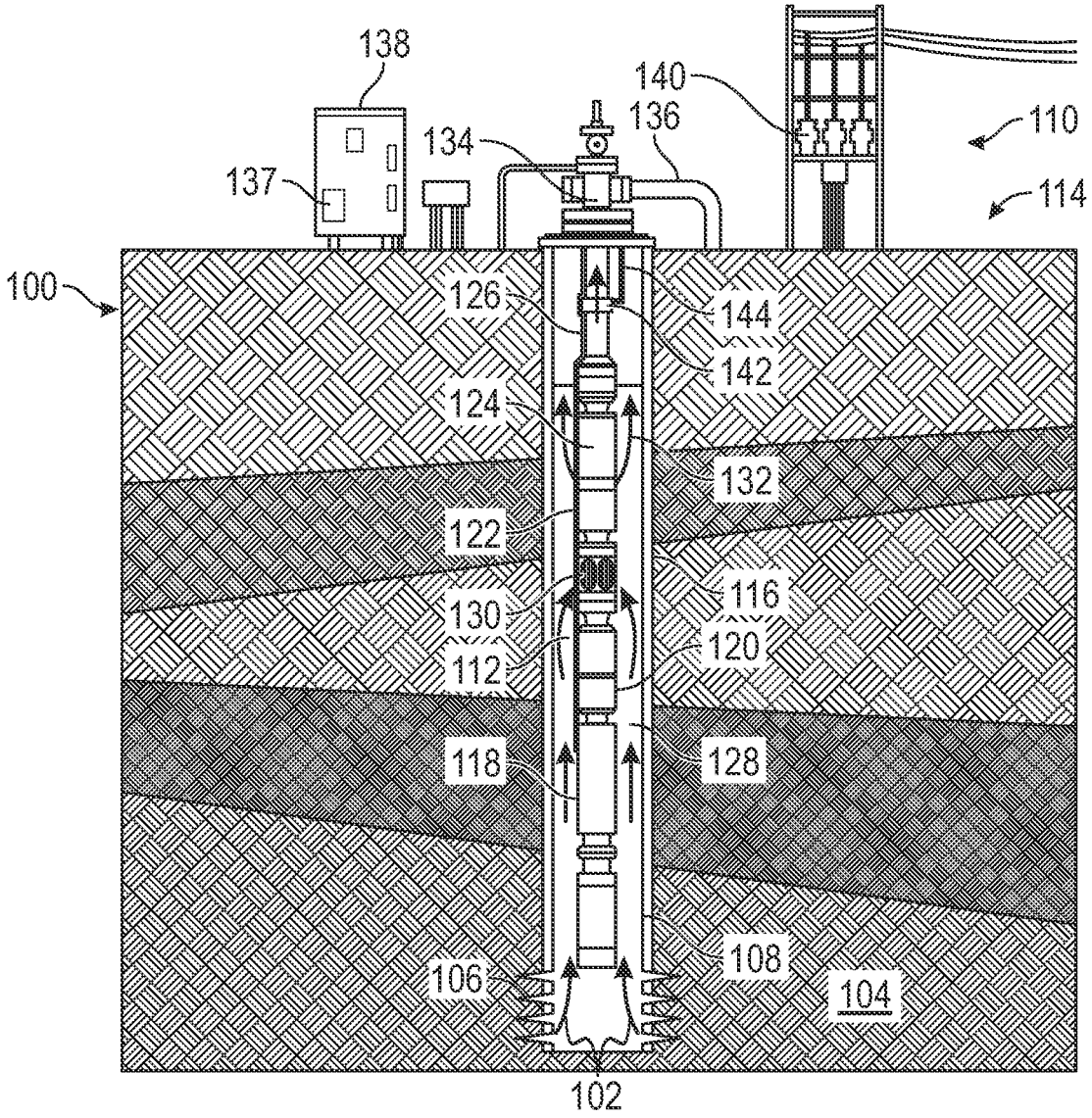
FIG. 1 shows an exemplary well with an Electrical Submersible Pump (ESP) completion design in accordance with one or more embodiments.

FIG. 1 shows an exemplary ESP system (100). The ESP system (100) is used to help produce produced fluids (102) from a formation (104). Perforations (106) in the well's (116) casing string (108) provide a conduit for the produced fluids (102) to enter the well (116) from the formation (104). The ESP system (100) includes surface equipment (110) and an ESP string (112). The ESP string (112) is deployed in a well (116) and the surface equipment (110) is located on the surface (114). The surface (114) is any location outside of the well (116), such as the Earth's surface.

The ESP string (112) may include a motor (118), motor protectors (120), a gas separator (122), a multi-stage centrifugal pump (124) (herein called a "pump" (124)), and an electrical cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (116) to the surface (114). The motor (118) is cooled by the produced fluids (102) passing over the motor (118) housing. The motor (118) is powered by the electrical cable (126). The electrical cable (126) may also provide power to downhole pressure sensors or onboard electronics that may be used for communication. The electrical cable (126) is an electrically conductive cable that is capable of transferring information. The electrical cable (126) transfers energy from the surface equipment (110) to the motor (118). The electrical cable (126) may be a three-phase electric cable that is specially designed for downhole environments. The electrical cable (126) may be clamped to the ESP string (112) in order to limit electrical cable (126) movement in the well (116). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) are located above (i.e., closer to the surface (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (116) between the casing string (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity. The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface (114).

In other embodiments, sensors may be installed in various locations along the ESP string (112) to gather downhole data such as pump intake volumes, discharge pressures, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface (114), the produced fluids (102) flow through the wellhead (134) into production equipment (136). The production equipment (136) may be any equipment that can gather or transport the produced fluids (102) such as a pipeline or a tank.

The ESP system may include a sub-surface safety valve (SSSV) (142) installed within the ESP string (112). The SSSV (142) may be installed near the surface (114). The SSSV (142) is a valve, such as a flapper valve, that may be used to block the produced fluids (102) from flowing up the ESP string (112) and to the surface (114). The SSSV (142) may be used as part of the shut-in system of the well (116). In scenarios where the well (116) needs to be shut in, such as for repairs or in an emergency, the SSSV (142) along with other valves located in the wellhead (134) are closed. The SSSV (142) may be controlled using a SSSV control line (144). The SSSV control line (144) may connect the SSSV (142) to a control module at the surface (114). The SSSV control line (144) may be a conduit for hydraulic fluid. The control module may use the hydraulic fluid, within the SSSV control line (144), to open or close the SSSV (142).

The remainder of the ESP system (100) includes various surface equipment (110) such as electric drives (137), pump control equipment (138), the control module, and an electric power supply (140). The electric power supply (140) provides energy to the motor (118) through the electrical cable (126). The electric power supply (140) may be a commercial power distribution system or a portable power source such as a generator. The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

ESP completion schemes, such as the one shown in FIG. 1, are designed to last a long time; however, over the life of the well (116) components of the ESP completion scheme such as the ESP string (112), the SSSV (142), or the wellhead (134) may fail. When the SSSV (142) or the wellhead (134) fail, they must be repaired or replaced. In order to repair or replace the SSSV (142) and/or the wellhead (134), the ESP string (112), even if the ESP string (112) itself is functional, must be removed from the well (116). When the ESP string (112) is removed from the well (116), the ESP string (112) must be de-completed. This causes the ESP string (112) to become defunct, and a new ESP string (112) must be used after the SSSV (142) or the wellhead (134) is repaired or replaced. Embodiments disclosed herein present an ESP completion scheme that allows for an ESP string (112) to be connected and disconnected in two sections without causing damage to the ESP string (112). This scheme allows for a portion of the ESP string (112) to be removed from the well (116) while a second portion is left downhole. The portion of the ESP string (112) that was removed from the well (116) may be run back in the well (116) to reconnect with the second portion after repairs or replacements have been completed.

Figure 2A:
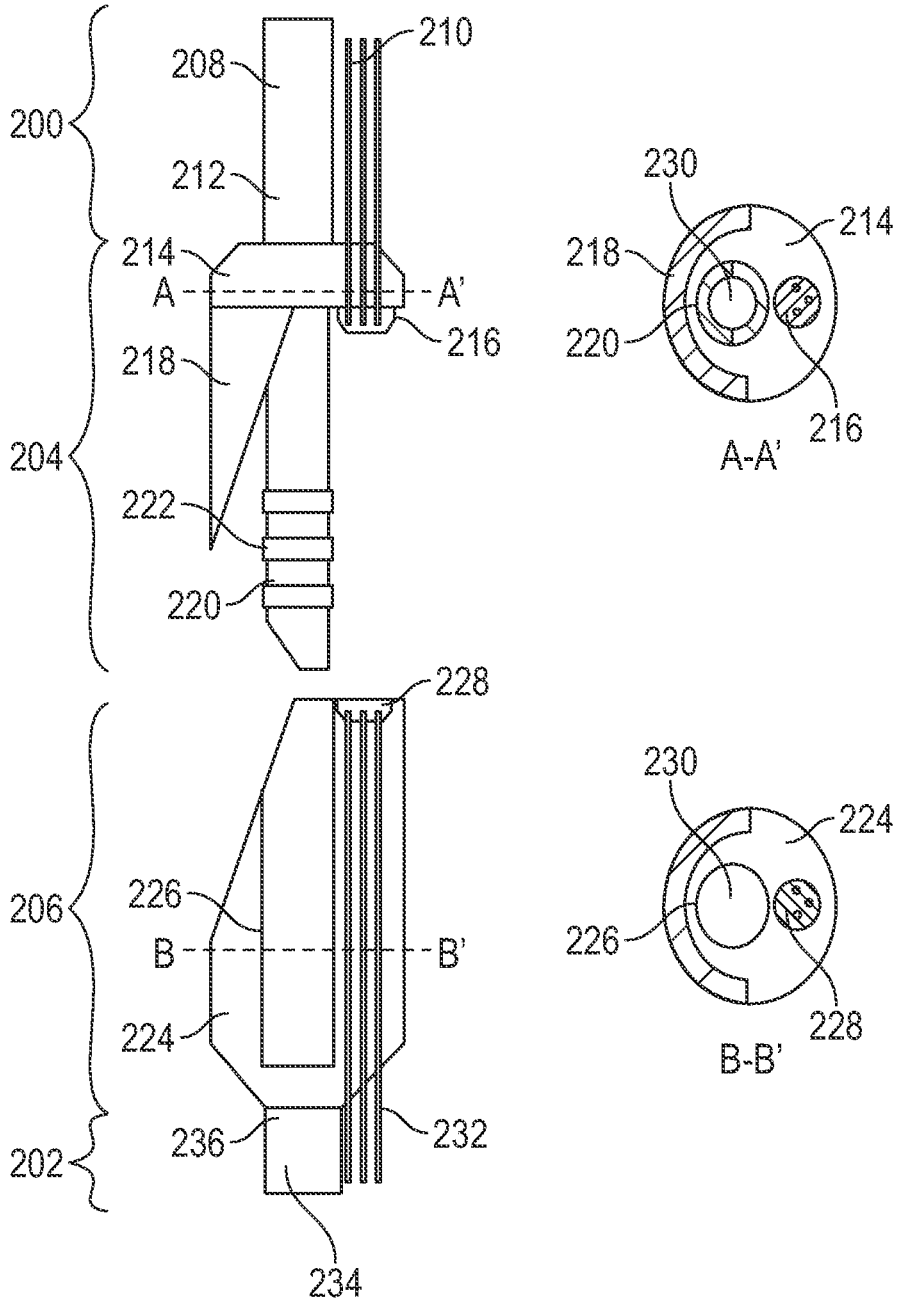
FIGS. 2*a* and 2*b* show a system in accordance with one or more embodiments.
Figure 2B:
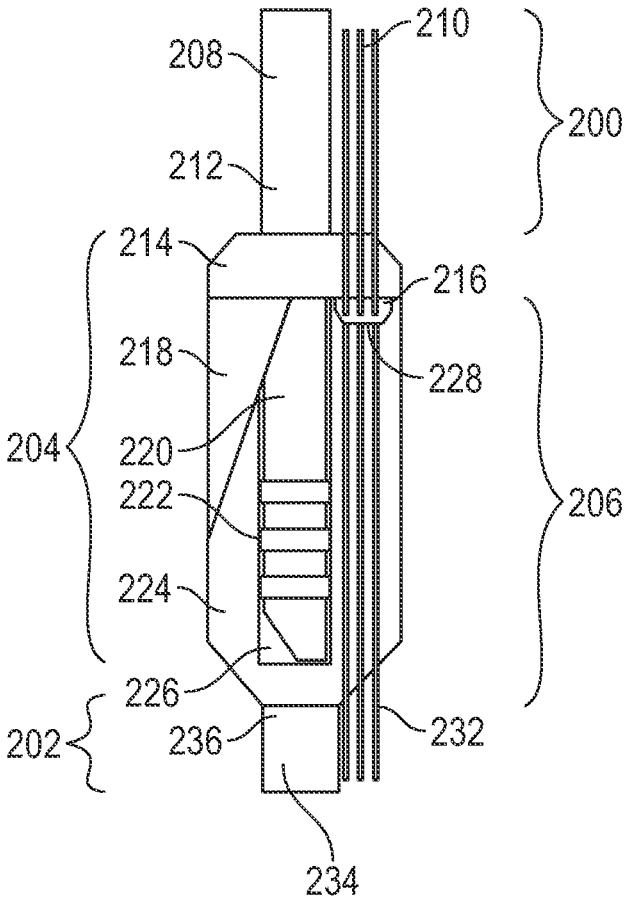

FIGS. 2*a* and 2*b* show a system for connecting an upper section (200) of an ESP string (112) to a lower section (202) of the ESP string (112). Components of FIGS. 2*a* and 2*b* that are similar to the components depicted in FIG. 1 have not be redescribed for purposes of readability and have the same function as described above. The system may be used while the ESP string (112) is in the well (116). Specifically, FIG. 2*a* shows the system as separate components and FIG. 2*b* shows the system when the separate components have been combined. The system includes the upper section (200), the lower section (202), a stinger assembly (204), and a stinger receptacle (206). The stinger assembly (204) may be connected to the upper section (200) and the stinger receptacle (206) may be connected to the lower section (202). The stinger receptacle (206) may receive the stinger assembly (204) to create an electrical connection, and a flow path, between the upper section (200) and the lower section (202). The stinger receptacle (206) may also release the stinger assembly (204) to disconnect the electrical connection.

The upper section (200) is made up of an upper portion of the ESP string (112) (i.e., the portion of the ESP string (112) located near the surface (114) of the well (116)), such as upper production tubing (208) and the SSSV (142). The upper production tubing (208) may be one or more cylindrical pipes connected together. The upper production tubing (208) may be made of any material that is able to handle the production conditions, such as steel. The pipes may be connected together by threaded means or by any other means known in the art. The upper section (200) may also include any of the ESP string (112) equipment located near the surface (114) such as the SSSV (142), the SSSV control line (144), and an upper electrical cable (210). The upper electrical cable (210) is similar to the electrical cable (126) described in FIG. 1.

The upper section (200) may have a first lateral end (212) located on the portion of the upper section (200) furthest away from the surface (114) of the well (116). The stinger assembly (204) may be fixed to the first lateral end (212) of the upper section (200). The stinger assembly (204) is made of a no-go locator (214), a guide (218), a male coupling (216) a stinger (220), and at least one seal (222). The stinger receptacle (206) is made of a body (224) having a stinger interface (226) and a female coupling (228). The no-go locator (214) is connected to the upper production tubing (208) by any means known in the art such as being threaded. The guide (218) may be connected to the no-go locator (214) by any means known in the art such as being welded.

The no-go locator (214) prevents the stinger assembly (204) and upper section (200) from moving downwards (away from the surface (114)) past the stinger receptacle (206). The no-go locator (214) performs said function by having a size larger than the annulus created between the stinger receptacle (206) and the casing string (108). The guide (218) is designed in such a way that the stinger assembly (204) is rotated to align properly with the stinger receptacle (206) and the stinger interface (226) located in the body (224) of the stinger receptacle (206). The guide (218) and the no-go locator (214) are depicted as two separate components; however, the guide (218) and the no-go locator (214) may be machined as one component.

The stinger (220) is connected to the no-go locator (214) by any means known in the art, such as being welded or being machined as one component. The stinger (220) may be a cylinder having an internal orifice (230) that allows the stinger (220) to be a conduit for production fluids. The stinger (220) may be designed to fit flush within the stinger interface (226) of the stinger receptacle (206). The guide (218) aligns the stinger (220) to be in the correct position, downhole, to be flush with the stinger interface (226) while the stinger (220) is being inserted into the stinger interface (226). The stinger (220) may have one or more seals (222) disposed around an outer circumference of the stinger (220). The seals (222) may be made of any material such as rubber. The seals (222) seal the space created between the stinger (220) and the stinger interface (226) when the stinger (220) is inserted into the stinger interface (226). The no-go locator (214), the guide (218), and the stinger (220) may be made of any material such as steel.

The male coupling (216) is an electrical coupling that is connected to the upper electrical cable (210). The female coupling (228) is an electrical coupling that is connected to a lower electrical cable (232). The lower electrical cable (232) is similar to the electrical cable depicted in FIG. 1. The female coupling (228) is designed to receive the male coupling (216) such that an electrical connection is created between the upper electrical cable (210) and the lower electrical cable (thus an electrical connection is created between the upper section (200) and the lower section (202)).

The stinger interface (226) is a machined space within the body (224) of the stinger receptacle (206). The stinger interface (226) is designed to receive the stinger (220). The body (224) of the stinger receptacle (206) may be made of any material such as steel. The body (224) of the stinger receptacle (206) further includes the orifice (230) that allows the production fluids to flow from the lower section (202) to the upper section (200) through the stinger (220). The lower section (202) is made up of the lower portion of the ESP string (112) (i.e., the portion of the ESP string (112) furthest from the surface (114) of the well (116)) and may include lower production tubing (234) and lower ESP string (112) equipment such as the ESP pump assembly. The lower section (202) may also include the lower electrical cable (232).

The lower production tubing (234) may be one or more cylindrical pipes connected together. The lower production tubing (234) may be made of any material that is able to handle the production conditions, such as steel. The pipes may be connected together by threaded means or by any other means known in the art. The lower section (202) may have a second lateral end (236) which may be the end of the lower section (202) closest to the surface (114) of the well (116). The stinger receptacle (206) may be fixed to the second lateral end (236) of the lower section (202). The stinger receptacle (206) may be fixed to the lower section (202) by the body of the stinger receptacle (206). The body may be fixed to the lower section (202) by any means known in the art, such as being welded.

Figure 3:
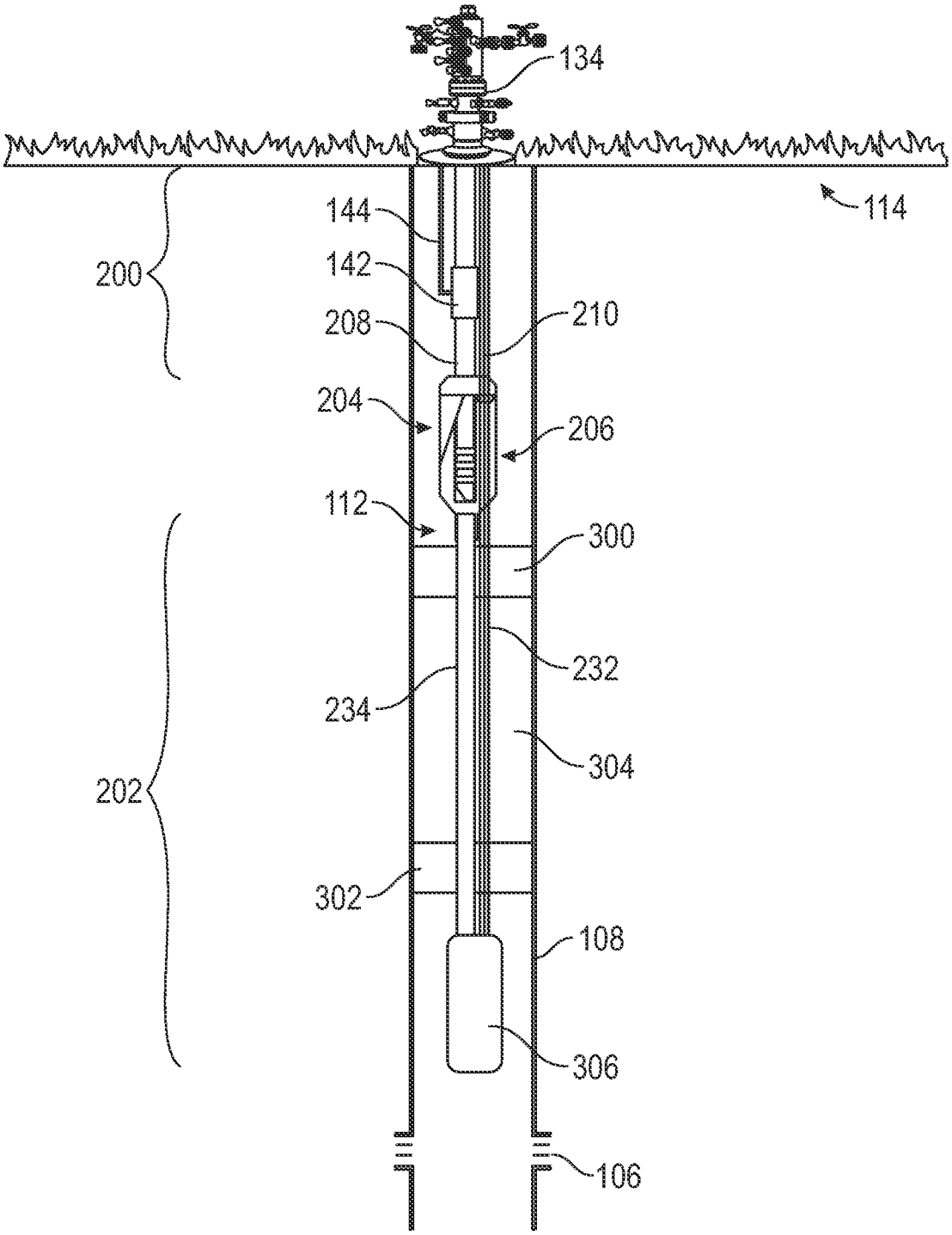
FIG. 3 shows the system within an ESP completion design in accordance with one or more embodiments.

FIG. 3 shows the system, described above in FIGS. 2*a* and 2*b*, used in a well (116) to connect an upper section (200) of an ESP string (112) to a lower section (202) of the ESP string (112) in accordance with one or more embodiments. Components of FIG. 3 that are similar to components described in FIGS. 1-2*b* have not been redescribed for purposes of readability and have the same function as described above.

Specifically, FIG. 3 shows a well (116) completed with an ESP string (112), a stinger assembly (204), a stinger receptacle (206), and an anchor (300).

The ESP string (112) has an upper section (200) and a lower section (202). The upper section (200) includes upper production tubing (208), the SSSV (142), the SSSV control line (144), and the upper electrical cable (210). The upper section (200) is connected to the wellhead (134) at the surface (114). The stinger assembly (204) is connected to the upper section (200), and the stinger assembly (204) is connected to the stinger receptacle (206). In one or more embodiments, the stinger assembly (204) and the stinger receptacle (206) are 300 feet below the wellhead (134). The stinger receptacle (206) is connected to the lower section (202). The lower section (202) includes the lower production tubing (234), the lower electrical cable (232), the anchor (300), a packer, and an ESP pump assembly (306).

The anchor (300) is set within the casing string (108), below the stinger receptacle (206). The anchor (300) is similar to packer technology; however, the anchor (300) must be designed to hold the weight of the ESP string (112) within the casing string (108), such that, when the stinger assembly (204) is released from the stinger receptacle (206), the stinger receptacle (206) along with the entirety of the lower section (202) are able to be held in place within the well (116). The packer (302) may be an ESP packer (302) that is set above the ESP pump assembly (306) and below the anchor (300). The ESP packer (302) is set within the casing string (108) and prevents production fluid from entering an upper annulus (304). The upper annulus (304) is the space between the ESP string (112) and the casing string (108) located above the packer (302). The ESP pump assembly (306) is the portion of the ESP string (112) including the multi-stage centrifugal pump (124) and the motor (118).

The motor (118) requires power from the electrical cable (126) to operate. As such, when the stinger assembly (204) is inserted into the stinger receptacle (206), the upper electrical cable (210) and the lower electrical cable (232) connect through the male coupling (216) and the female coupling (228). This creates the electrical connection between the upper section (200) and the lower section (202) allowing for electricity/power to be transferred from the surface (114) to the upper electrical cable (210), to the lower electrical cable (232), and finally to the motor (118). When the stinger assembly (204) is removed from the stinger receptacle (206), the electrical connection is disconnected, and the motor (118) no longer receives power.

Figure 4:
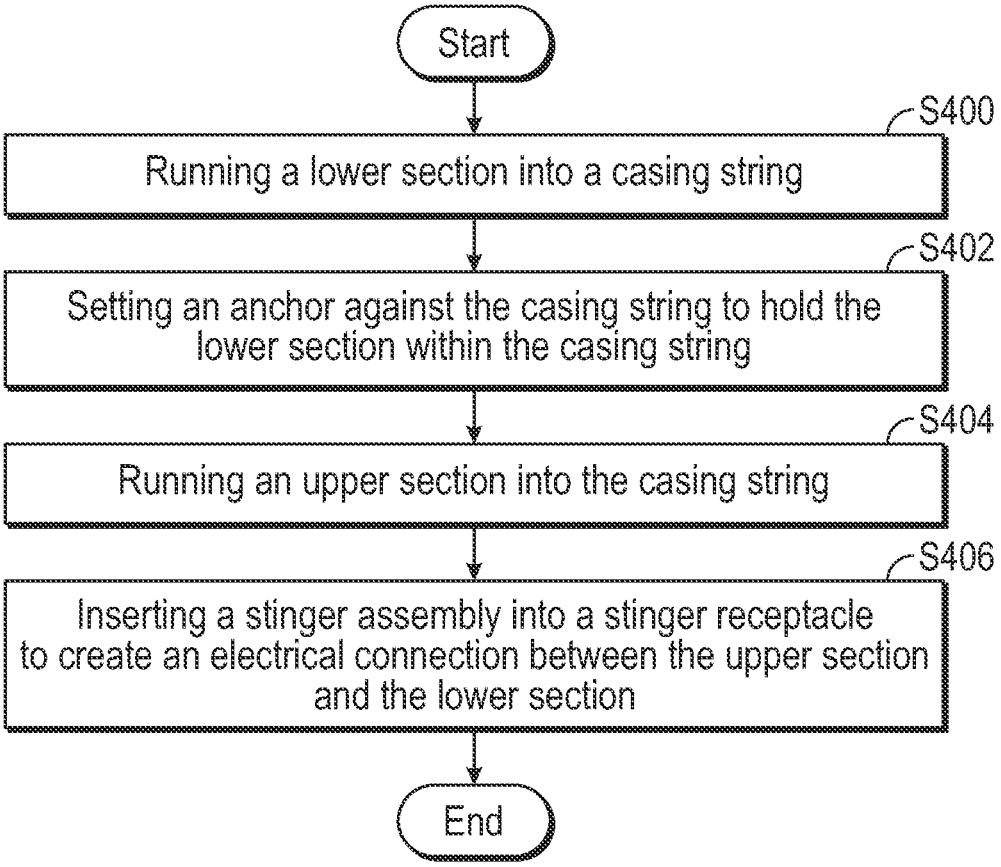
FIG. 4 shows a flowchart in accordance with one or more embodiments.

FIG. 4 depicts a flowchart in accordance with one or more embodiments. More specifically, FIG. 4 illustrates a method for using a stinger assembly (204) and a stinger receptacle (206) to connect an upper section (200) and a lower section (202) of an ESP string (112). Further, one or more blocks in FIG. 4 may be performed by one or more components as described in FIGS. 1-3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a lower section (202) is run into a casing string (108) (S400). The lower section (202) is a portion of an ESP string (112) that is designed to be installed furthest from the surface (114) of a well (116). The lower section (202) has a weight and includes lower production tubing (234) designed to be a conduit for production fluids, a lower electrical cable (232) designed to transmit electricity, a stinger receptacle (206) designed to receive a stinger assembly (204), an ESP assembly (306), and an anchor (300) designed to hold the weight of the lower section (202) in the casing string (108).

The anchor (300) is set against the casing string (108) to hold the lower section (202) within the casing string (108) (S402). A packer (302) located above the ESP assembly (306) and below the anchor (300), along the lower section (202), may be set in the casing string (108) to prevent production fluid from entering an upper annulus (304) located between the ESP string (112) and the casing string (108). An upper section (200) is run into the casing string (108) (S404). The upper section (200) includes upper production tubing (208) designed to be a conduit for the production fluids, an upper electrical cable (210) designed to transmit electricity, the stinger assembly (204) designed to enter the stinger receptacle (206), and a SSSV (142) fixed to the upper production tubing (208). Further, the upper section (200) includes the SSSV control line (144) that may be used to open and close the SSSV (142).

The stinger assembly (204) is inserted into the stinger receptacle (206) to create an electrical connection between the upper section and the lower section (202) (S406). The stinger assembly (204) includes a stinger (220) that is guided, by a guide (218), into a stinger interface (226) located within the body (224) of the stinger receptacle (206). A seal, located around the stinger (220) creates a fluid-tight seal between the stinger (220) and the stinger interface (226). The stinger assembly (204) also includes a male coupling (216) that is connected to the upper electrical cable (210), and the stinger receptacle (206) includes a female coupling (228) that is connected to the lower electrical cable (232). The female coupling (228) receives the male coupling (216) when the stinger (220) is inserted into the stinger interface (226), thus creating the electrical connection between the upper section (200) and the lower section (202).

A motor (118), fixed within the ESP assembly (306), is powered by transferring electricity from the upper electrical cable (210) to the lower electrical cable (232) through the male coupling (216) and the female coupling (228). In further embodiments, when the SSSV (142) or the wellhead (134) need to be repaired or replaced, the upper section (200) of the ESP string (112) may be removed from the well (116), without damaging the ESP string (112) by releasing the stinger assembly (204) from the stinger receptacle (206). The stinger assembly (204) may be released by pulling up on the upper section (200). The upper section (200) may then be reused, after repairs/replacements have been completed, by running the upper section (200) and the stinger assembly (204) into the casing string (108) to be re-inserted into the stinger receptacle (206).

Embodiments disclosed above describe using the stinger assembly (204) and the stinger receptacle (206) with an ESP string (112); however, any equipment that requires a power source may be used as the upper section (200) and the lower section (202) without departing from the scope of this disclosure. Further, those skilled in the art will appreciate that other variations of the ESP completion design, such as designs with multiple packers, different valves, etc., may be used without departing from the scope of this disclosure.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plusfunction clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for a well having a casing string, the system comprising:

an upper section, having a first lateral end, comprising:

upper production tubing configured to be a conduit for production fluids;

an upper electrical cable configured to transmit electricity; and a sub-surface safety valve fixed to the upper production tubing;

a lower section, having a second lateral end, comprising:

lower production tubing configured to be a conduit for the production fluids;

a lower electrical cable configured to transmit electricity;

an electric submersible pump assembly; and an anchor configured to hold the lower section within the casing string;

a stinger assembly fixed to the first lateral end of the upper section, the stinger assembly comprising:

a no-go locator connected to the upper production tubing; and a stinger extending from the no-go locator and having a smaller diameter than the no-go locator, wherein the upper electrical cable extends from surface equipment vertically into a body of the no-go locator of the stinger assembly; and a stinger receptacle fixed to the second lateral end of the lower section, the stinger receptacle comprising:

a body connected to the lower production tubing; and an orifice extending through the body and delineated by a stinger interface, wherein the lower electrical cable extends vertically from the body of the stinger receptacle to the electric submersible pump assembly, wherein the stinger of the stinger assembly is configured to enter the orifice of the stinger receptacle and seal against the stinger interface and the stinger receptacle is configured to receive the stinger assembly in a way that allows the upper electrical cable and the lower electrical cable to mate along a singular axis to create an electrical connection between the upper section and the lower section.

2. The system of claim 1, wherein the stinger assembly comprises a male coupling, connected to the upper electrical cable, and the stinger receptacle comprises a female coupling, connected to the lower electrical cable.

3. The system of claim 2, wherein the female coupling is configured to receive the male coupling to create the electrical connection between the upper section and the lower section.

4. The system of claim 3, wherein the electric submersible pump assembly comprises a motor powered by electricity transferred from the upper electrical cable to the lower electrical cable.

5. The system of claim 1, wherein the stinger receptacle is configured to release the stinger assembly and disconnect the electrical connection.

6. The system of claim 1, further comprising:

a guide, fixed to the no-go locator, that aligns the stinger with the stinger interface during insertion of the stinger into the stinger receptacle.

7. The system of claim 6, further comprising:

a seal, disposed around the stinger, wherein the seal seals against the stinger interface upon insertion of the stinger into the stinger interface.

8. The system of claim 1, wherein the lower section further comprises a packer, fixed within the casing string.

9. A method for a well having a casing string, the method comprising:

running a lower section, having a weight, into the casing string, wherein the lower section comprises:

lower production tubing configured to be a conduit for production fluids;

a lower electrical cable configured to transmit electricity;

an electric submersible pump assembly;

a stinger receptacle configured to receive a stinger assembly, the stinger receptacle comprising:

a body connected to the lower producing tubing; and an orifice extending through the body and delineated by a stinger interface wherein the lower electrical cable extends vertically from the body of the stinger receptacle to the electric submersible pump assembly;

and an anchor configured to hold the weight of the lower section;

setting the anchor against the casing string to hold the lower section within the casing string;

running an upper section into the casing string, wherein the upper section comprises:

upper production tubing configured to be a conduit for the production fluids;

an upper electrical cable configured to transmit electricity;

the stinger assembly configured to enter the stinger receptacle, the stinger assembly comprising:

a no-go locator connected to the upper production tubing; and a stinger extending from the no-go locator and having a smaller diameter than the no-go locator, wherein the upper electrical cable extends from surface equipment vertically into a body of the no-go locator in the stinger assembly; and a sub-surface safety valve fixed to the upper production tubing; and inserting the stinger of the stinger assembly into the orifice of the stinger receptacle to seal the stinger against the stringer interface, wherein the stinger receptacle receives the stinger assembly in a way that allows the upper electrical cable and the lower electrical cable to mate along a singular axis to create an electrical connection between the upper section and the lower section.

10. The method of claim 9, wherein the stinger assembly comprises a male coupling, connected to the upper electrical cable, and the stinger receptacle comprises a female coupling, connected to the lower electrical cable.

11. The method of claim 10, further comprising:

receiving the male coupling by the female coupling to create the electrical connection between the upper section and the lower section.

12. The method of claim 11, further comprising:

powering a motor, fixed within the electric submersible pump assembly, by transferring electricity from the upper electrical cable to the lower electrical cable.

13. The method of claim 9, further comprising:

releasing the stinger assembly from the stinger receptacle to disconnect the electrical connection.

14. The method of claim 9, further comprising:

preventing the stinger assembly from moving downwards using the no-go locator.

15. The method of claim 9, further comprising:

aligning the stinger to the stinger interface using a guide, connected to the no-go locator.

16. The method of claim 15, further comprising:

sealing a space between the stinger and the stinger interface using a seal, disposed around the stinger.

17. The method of claim 9, further comprising:

preventing production fluid from entering an upper annulus by setting a packer in the casing string.

* * * * *